United States Patent [19]

Marecek et al.

[11] 4,146,356

[45] Mar. 27, 1979

[54] FLASHLAMP ARTICLE HAVING INTERNALLY LOCATED COMBUSTIBLE MEMBER

[75] Inventors: Paul M. Marecek, Montoursville; John W. Shaffer, Williamsport, both of Pa.

[73] Assignee: GTE Sylvania Incorporated, Danvers, Mass.

[21] Appl. No.: 831,008

[22] Filed: Sep. 6, 1977

[51] Int. Cl.[2] ..... G08B 13/02; F21K 5/02

[52] U.S. Cl. ..... 431/361; 116/83; 102/37.2; 102/31

[58] Field of Search ..... 116/7, 11, 83, 87; 431/92, 93; 102/33, 37, 37.2, 204; 362/8, 11, 14

[56] References Cited

U.S. PATENT DOCUMENTS

| | | | |
|---|---|---|---|
| 3,535,063 | 10/1970 | Anderson et al. | 431/93 |
| 3,597,604 | 8/1971 | Shaffer | 431/92 |
| 3,724,990 | 4/1973 | Schupp | 431/93 |
| 3,911,823 | 10/1975 | Murray et al. | 102/204 |
| 3,947,221 | 3/1976 | Mauser | 431/93 |

*Primary Examiner*—Carroll B. Dority, Jr.
*Attorney, Agent, or Firm*—Lawrence R. Fraley

[57] ABSTRACT

There is disclosed a multi-flashlamp article capable of providing both highly intense audible and visual signals. The article is ideally suited for use as an intrusion alarm and includes a combustible member within the assembly's light-transmittable housing. A prestressed spring actuates the combustible by deforming a tubular primer having a quantity of fulminating material therein. This deflagrating material ignites a second quantity of fulminating material within the combustible's container to effect a suitable audible signal.

15 Claims, 6 Drawing Figures

FLASHLAMP ARTICLE HAVING INTERNALLY LOCATED COMBUSTIBLE MEMBER

CROSS REFERENCE TO COPENDING APPLICATIONS

An application listed in the Patent and Trademark Office under Ser. No. 831,068 and entitled "Multilamp Flashlamp Article Having Combustible Member Therein" (P.M. Marecek et al), was filed Sept. 6, 1977. Ser. No. 831,068 is a design application.

Two additional applications listed under Ser. Nos. 803,564 and 803,565 were filed June 6, 1977 and are assigned to the assignee of the present invention. Ser. No. 803,565, entitled "Flashlamp Assembly for Providing Highly Intense Audible and Visual Signals" (A.C. Bouchard et al.), defines a multilamp flashlamp assembly which incorporates a combustible member for each lamp. The combustibles provide highly intense audible signals in response to receipt of the radiant energy from the fired flashlamps. Ser. No. 803,564, entitled "Activating Mechanism for Flashlamp Article" (A.C. Bouchard et al), defines several embodiments of activating mechanisms which may trigger a flashlamp article similar to the one defined in Ser. No. 803,565.

Another application, listed under Ser. No. 803,563 and entitled "Activation Means for Flashlamp Article" (R. G. Blaisdell et al), defines a flashlamp article activator which incorporates a biasing means therein for substantially preventing accidental firing of the flashlamp article. Ser. No. 803,564 was also filed June 6, 1977 and is assigned to the assignee of this invention.

BACKGROUND OF THE INVENTION

The present invention relates to signal assemblies and more particularly to signal assemblies which utilize flashlamps. Even more particularly, the invention relates to flashlamp signal assemblies capable of being used as an alarm unit or part of an alarm system.

The flashlamp assembly defined in the aforementioned application under Ser. No. 803,565 uses a combustible member (e.g. a pyrotechnic) which provides a highly intense audible signal when the member receives the intense energy from a flashlamp located within the assembly. Either the heat or light emitted from the flashed lamp triggers the combustible.

The flashlamp article of the present invention, on the other hand, utilizes a combustible member which is actuated by means within the article's housing to provide a highly intense, audible signal through a respective opening within the housing. This arrangement eliminates the need for externally positioning combustible elements on the exterior surface of the article's housing. This arrangement also eliminates the previous requirement that the operation of the combustible member be dependent on that of one of the adjacent flashlamps.

It is believed threrefore that a flashlamp article which utilizes a independently operating combustible member within the assembly to provide a highly intense audible signal through the article's housing in addition to the intense flash from the article's lamps would constitute advancement in the art.

It will be understood from the following description that the flashlamp article of the invention is capable of being activated by the various mechanisms defined in the above copending applications.

OBJECTS AND SUMMARY OF THE INVENTION

It is, therefore, a primary object of the present invention to provide a signal assembly which utilizes flashlamps.

It is another object of the invention to provide a flashlamp signal assembly which is also capable of producing a highly intense audible signal.

It is still another object of the invention to provide a flashlamp signal assembly wherein the flashlamp and noise-emitting components operate independently.

It is a further object of the invention to provide a flashlamp signal assembly of the type described above wherein the assembly is particularly suited for use as an intrusion alarm device.

According to one aspect of the invention, a combustible member is provided which comprises a container and means for substantially sealing one end of the container. A first quantity of fulminating material is positioned within a cavity defined within said container and a hollow, deformable member projects from the container. A second quantity of fulminating material within the hollow member ignites the first quantity upon deformation of the hollow member.

According to another aspect of the invention, an article is provided which produces both highly intense audible and visual signals. The article comprises a housing, at least one flashlamp within the housing, a combustible member which provides a highly intense audible signal in response to actuation thereof, and a means for actuating the combustible member.

DETAILED DESCRIPTION OF THE PREFERRED EMBODIMENTS

For a better understanding of the present invention together with other and further objects, advantages and capabilities thereof, reference is made to the following disclosure and appended claims in connection with the above described drawings.

Figure 1:
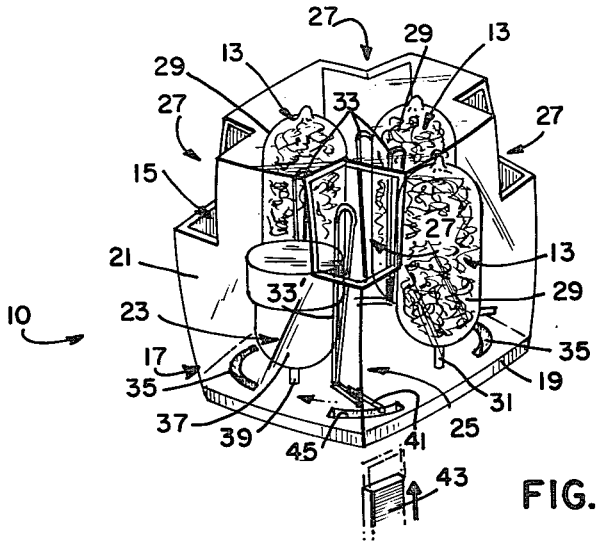
FIG. 1 is an isometric view of a flashlamp article according to one embodiment of the invention.

In FIG. 1 is shown a flashlamp article 10 which is capable of providing highly intense audible and visual signals when activated. By highly intense audible is meant a signal above approximately 85 decibles at a distance of 25 centimeters. For purposes of alarm, the function of the audible signal provided by the present invention is to frighten away a prospective intruder in addition to warning the occupants of a residence as to said intrusion. The invention as will be described is fully capable of emitting highly intense audible signals substantially greater than 100 decibels, for example, 130 to 155 decibels at the described 25 centimeter range. By highy intense visual is meant a visible signal similar to those emitted from known flashbulb and flashcube components. It will be understood from the following description that assembly 10 is capable of using electrically-activated flashbulbs, such components capable of emitting intense light within the range of about 5000 to 20,000 lumen seconds with a peak intensity occurring within a range of about 10 to about 20 milliseconds. These lamps are currently available on the market and sold under the names Ag-1, AG-1B, M-2, etc. Another form of electrically-actiated lamps which may be used in the present invention are those known in the art as high voltage lamps. These articles are typically electrically joined to a power source such as a piezoelectric crystal, which when deformed will provide sufficient electrical current to the respective flashlamp to achieve firing thereof.

It is preferred in the present invention to utilize flashlamps which are dependent on percussive activation to achieve firing. Perhaps the best known of these are the percussively-ignitable flashlamps used in the currently marketed photoflash article "MAGICUBE", said articles produced and sold under this name by the assignee of the present invention. One example of these lamps is defined in U.S. Pat. No. 3,535,063 (L. F. Anderson et al) which is assigned to the assignee of the present invention. Such flashlamps typically emit a visual signal of about 2000 beam candle power seconds with a peak intensity occurring between 5 and 10 milliseconds.

Article 10 comprises at least one and preferably several (e.g. three) percussively-ignitable flashlamps 13 positioned within a chamber 15 defined by the article's housing 17. Housing 17 includes a base portion 19 and a cover portion 21 attached thereto and having at least a portion thereof light-transmittable. Preferably, all of cover portion 21 is light-transmittable to enhance the emission of the intense light. Except for indicated alterations thereto, base portion 19 and cover portion 21 are preferably similar to those used in the aforementioned "MAGICUBE" photoflash article.

Article 10 further comprises at least one combustible member 23 also positioned within chamber 15. Member 23 provides the described highly intense audible signal when actuated by an actuation means 25 also positioned within chamber 15 and adjacent member 23. The signal from member 23 passes through at least one opening 27 within cover portion 21. When utilizing a preferred ratio of three flashlamps 13 and one combustible member 23, cover portion 21 preferably contains four openings 27 located in opposing corners of the cover. Accordingly cover 21 is peferably of boxlike (or cubical) configuration.

Each lamp 13 includes a light-transmitting envelope 29 and a primer tube 31 projecting therefrom and seated within base portion 19. A prestressed striker spring 33 is located adjacent each lamp and activates the respective lamp by striking and deforming primer tube 31. Thereafter, a quantity of fulminating material therein deflagrates up through the primer to ignite the lamp's combustible material and produce the desired flash. This operation is described in the above U.S. Pat. No. 3,535,063 while a description of the striker spring and its operation is provided in U.S. Pat. No. 3,597,604 (J. W. Shaffer). U.S. Pat. No. 3,597,604 is also assigned to the assignee of the present invention. The preferred method for triggering springs 33 is to pass a respective actuator (not shown) up through a slot 35 within base 19 adjacent each of the springs. With regard to the present invention, it is preferred that actuation of springs 33 be accomplished by one of the actuating mechanisms in the above copending applications under Ser. Nos. 803,563, 803,564, and 803,565. Any of these mechanisms is fully capable of successfully triggering springs 33 when base portion 19 is positioned thereon.

Combustible member 23, as shown in FIG. 1, is preferably percussively-ignitable and includes a container 37 and a deformable hollow member 39 projecting therefrom and positioned within base 19. Accordingly, means 25 for actuating member 23 preferably comprises a prestressed striker spring 33' similar to springs 33 and including a striker arm 41 which strikes hollow member 39 when released by an engagement member 43 passing up through an opening 45 within base 19. Similar to the activation of lamps 13, release of striker arm 41 may be accomplished by one of the engagement members of the mechanisms described in the above copending applications.

Figure 2:
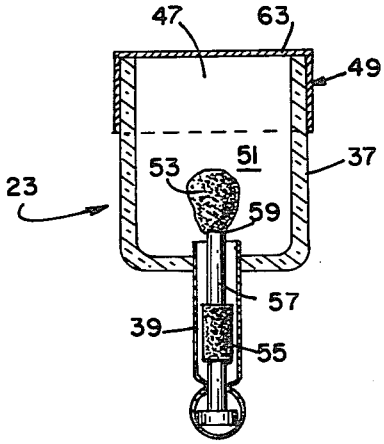
FIGS. 2–4 represent side elevational views, partly in section, of a combustible member in accordance with various embodiments of the invention.

With reference to FIG. 2, combustible member 23 is shown as comprising the above described container 37 and hollow member 39 projecting therefrom. Container 37 has an open end 47. Accordingly, there is provided a means 49 for sealing end 47 to thus define a cavity 51 within the container. A first quantity 53 of fulminating material is located within cavity 51 while a second quantity 55 of fulminating material is located within hollow member 39. Preferably, second quantity 55 is positioned on an elongated anvil 57 which is located within member 39. Accordingly, hollow member 39 projects from container 37 at a location relative or adjacent the first quantity 53. The above described container 37, hollow member 39, and anvil 57 are preferably similar to those used in the percussively-ignitable flashlamp defined in U.S. Pat. No. 3,535,063. The one significant difference is that the end of container (or envelope) 37 is removed to facilitate positioning of the first quantity 55 of fulminating material therein. Container (or envelope) 37 is therefore comprised of glass.

Figure 3:
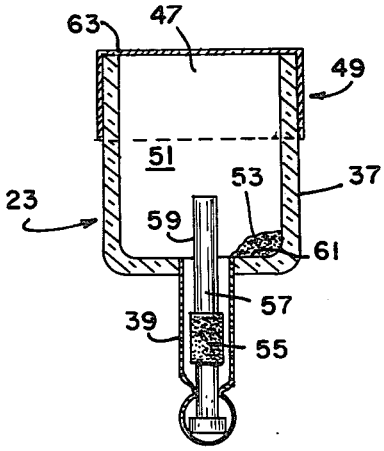
Figure 4:
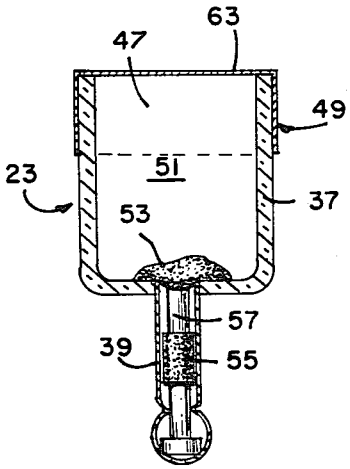

First quantity 53 is illustrated in FIG. 2 as being positioned on an end 59 of anvil 57 which extends within cavity 51. This is not meant to limit the invention however, in that this material may be located practically anywhere within cavity 51. For example, in FIG. 3 the first quantity 53 is shown as being positioned upon an inner surface 61 of container 37. Similarly, quantity 53 is shown in FIG. 4 as being located both on the inner surface 61 and in contact with the end of anvil 57. In FIGS. 2–4, both quantities of fulminating material are shown as being spaced apart within combustible member 23. The only criteria for positioning of quantity 53 is that it must be located in such a manner that it is readily ignitable by second quantity 55. This ignition occurs when hollow member 39 is deformed by striker arm 41 causing the fulminating material therein to deflagrate up through the member and ignite quantity 53. The rapid ignition of quantity 53 within the sealed cavity 51 causes instantaneous removal of sealing means 49 and an emission of the desired audible signal. From the foregoing description, it is readily understood that the fulminating material within member 39 is percussively-ignitable.

Sealing means 49 is preferably a thin metallic (e.g. 0.5 to 2 mil aluminum) cup 63 which is secured about end 47.

A suitable hot melt adhesive is preferably used to assure retention of cup 63. A moisture-tight seal is desired about end 47 particularly when using the following defined fulminating materials.

With regard to the invention, it is preferred to utilize similar fulminating materials for first and second quantities 53 and 55, respectively. Each quantity comprises a suitable phosphorous (preferably red), a water-soluble binder, and an oxidizer. The binder, when wet, comprises about 93.79 percent water, 2.98 percent hydroxyethyl cellulose, 0.17 percent sodium 2-ethyl hexyl sulfate, and 2.47 percent sodium lignin sulfonate. All of the above percentages are by weight. The binder and red phosphorous constitute a first part of the material while the oxidizer comprises the second. When preparing the first part, a solution comprising about 9.9 percent binder, 59.9 percent red phosphorous, and 30.2 percent water is mixed and thereafter dried. By dry weight, the binder will then constitute about 1.0 percent and the phosphorous the remaining 99 percent.

The preferred oxidizer for part two of the mixture is sodium chlorate ($NaClO_3$) although several other chlorates, chlorites, hypochlorites, or nitrates may be used.

In final (dried) form and as applied about anvil 57 and on surface 61, first and second quantities 53 and 55 each comprise (in percentages by weight) from about 0.5 to 5.0 percent water-soluble binder. Accordingly, the phosphorous and oxidizer each comprise from about 25 to 75 percent (by weight) of the remainder of the mixture. In terms of total weight, first quantity 53 preferably weighs from about 3.0 to 20.0 milligrams while second quantity 55 preferably weighs from about 0.30 to about 3.0 milligrams. The ratio of weights of first quantity 53 to second quantity 55 may therefore fall within the range of about 1:1 to about 65:1. These ratios are peferred when using a cavity 51 having a volume of about 500 $mm^3$ and an elongated cylindrical anvil 57 having a diameter of 1.0 mm. Hollow member 39 has an internal diameter of 1.4 mm and is about 8.2 mm long. Accordingly, the spacing between the external surface of anvil 57 and the internal wall of member 39 constitutes a volume of 6.2 $mm^3$.

Figure 6:
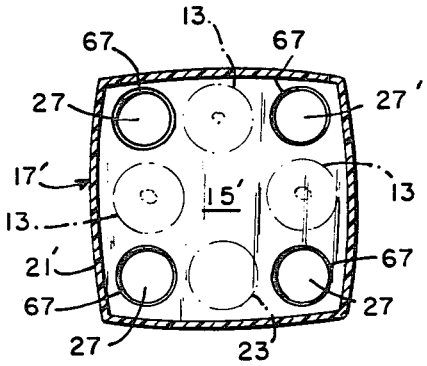
FIG. 6 is a plan view of the housing of FIG. 5 as taken along the line 6—6 therein.
Figure 5:
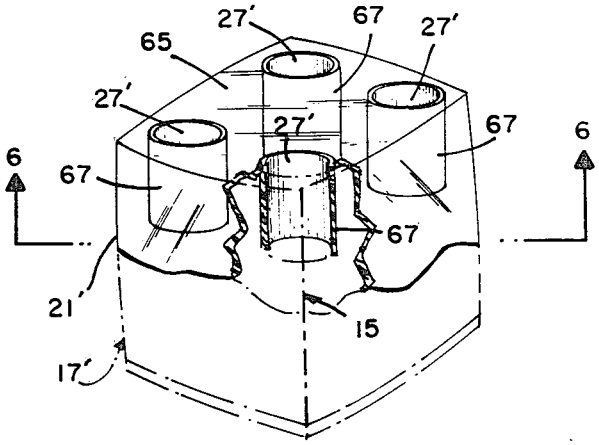
FIG. 5 is a partial isometric view of a housing according to another embodiment of the invention; and Lo

In FIGS. 5 and 6 there is shown a housing 17' and cover portion 21' in accordance with an alternate embodiment of the invention. Cover portion 21 includes four openings 27' therein each located in an opposing corner of one side 65 of the cover. Each opening 27' is preferably circular. It is also preferred in the embodiment of FIGS. 5 and 6 to include a cylindrical baffle member 67 adjacent each opening 27'. Each baffle 67 projects within the chamber (15') of housing 17' in order that a lamp 13 (shown in phantom in FIG. 6) or combustible member 23 (also in phantom) may be located between a respective pair of baffles. As shown in FIG. 6, the described ratio of three lamps to one combustible member is employed.

Other lamp-combustible member combinations are acceptable for use within article 10. The following list represents a few of these:

| Combination | #Lamps | #Combustible Members |
|---|---|---|
| 1 | 2 | 1 |
| 2 | 1 | 1 |
| 3 | 1 | 2 |
| 4 | 1 | 3 |
| 5 | 2 | 2 |

Thus there has been shown and described a flashlamp article capable of emitting both highly intense audible and visual signals. As described, the article is easy to manufacture and operate as well as being relatively safe. The invention is particularly suited for use as an intrusion alarm component when positioned on a suitable activating mechanism. Such mchanisms have been described in the aforementioned copending applications. The invention is also capable of being used in combination with a suitable sound and/or light detector which can emit a loud and continuous signal as well as perform other functions when triggered by the invention. When the invention is employed as an alarm component, it may be preferred to use a red pigment within the light transmitting cover, such a color indicative of warning situations.

As defined, the invention is highly reliable and eliminates the need for electrical circuitry. As earlier stated, however, it is possible to employ electrically-activated flashlamps within the invention. It is also possible to utilize a combustible member which is actuated by electrical means. That is, the projecting hollow member 39 could include a pair of electrical wires which would then be electrically joined to a suitable power source (e.g. battery) located externally of the invention. Electrical current through the wires could result in an arc through the respective fulminating material 55 to cause subsequent ignition thereof.

While there have been shown and described what are at present considered the preferred embodiments of the invention, it will be obvious to those skilled in the art that various changes and modifications may be made therein without departing from the scope of the invention as defined by the appended claims.

What is claimed is:

1. An article for producing highly intense audible and visual signals, said article comprising:

a housing defining a chamber therein, said housing including a base portion and a cover portion having at least one opening therein, at least part of said cover portion being light-transmittable;

at least one flashlamp positioned within said chamber of said housing, said flashlamp providing a highly intense visual signal in response to activation thereof, said visual signal passing through said light-transmittable part of said cover portion;

at least one combustible member positioned within said chamber of said housing, said combustible member providing a highly intense audible signal in response to actuation thereof, said audible alarm passing through said opening within said cover portion of said housing; and means for actuating said combustible member, said means located within said chamber and adjacent said combustible member.

2. The article according to claim 1 wherein said flashlamp is percussively-ignitable and includes a light-transmitting envelope and primer tube projecting therefrom, said article further including a prestressed striker spring positioned within said chamber adjacent said flashlamp for activating said flashlamp.

3. The article according to claim 1 wherein the number of flashlamps is three and the number of combustible members is one.

4. The article according to claim 1 wherein said combustible member is percussively-ignitable and includes a container and a deformable hollow member projecting therefrom, said means for actuating said combustible member comprising a prestressed striker spring for striking said hollow member to effect deformation thereof.

5. The article according to claim 4 wherein said container includes an open end, said article further including means for substantially sealing said open end to define a cavity therein, a first quantity of fulminating material located within said cavity, and a second quantity of fulminating material located within said hollow member for igniting said first quantity of fulminating material in response to said deformation of said hollow tube.

6. The article according to claim 1 wherein said cover member is of boxlike configuration and the number of openings therein is four, each of said openings located in an opposing corner of said cover member.

7. The article according to claim 1 wherein said cover member is of boxlike configuration and the number of openings therein is four, each of said openings located in an opposing corner of one side of said cover member.

8. The article according to claim 7 further including a baffle member located on said side of said cover member relative to each of said openings, said baffle members projecting within said chamber of said housing.

9. The article according to claim 8 wherein the number of flashlamps is three and the number of combustible members is one, each of said flashlamps and said combustible member positioned substantially between a respective pair of baffle members.

10. A percussively-ignitable combustible member for providing a highly intensive audible signal in response to actuation thereof, said combustible member comprising:

a glass container having an open end;

sealing means for sealing said open end to define a cavity within said container; said sealing means comprising a thin cup-shaped member sealed about the outer periphery of said glass container;

a hollow, deformable member projecting from said container and including an elongated anvil member positioned therein; and first and second quantities of fulminating material, said second quantity being percussively-ignitable and located within said deformable member on said anvil member, said first quantity of the same composition as said second quantity and located within said cavity of said container and spaced apart from said second quantity, said first quantity of material occupying only a minor portion of said cavity, said second quantity igniting said first quantity in response to deformation of said hollow member to cause instantaneous removal of said sealing means and emission of said highly intense audible signal.

11. The percussively-ignitable combustible member according to claim 10 wherein each of said quantities of fulminating material is comprised of phosphorus, a water-soluble binder, and an oxidizer, the ratio of weights of said first quantity to said second quantity within the range of about 1:1 to about 65:1.

12. The percussively-ignitable combustible member according to claim 11 wherein said first quantity of fulminating material weighs from about 3.0 to about 20.0 milligrams and said second quantity of fulminating material weighs from about 0.30 to about 3.0 milligrams.

13. The percussively-ignitable combustible member according to claim 10 wherein said anvil member includes an end portion which extends within said cavity of said container, said first quantity of fulminating material located on said extending end portion.

14. The percussively-ignitable combustible member according to claim 10 wherein said cup-shaped member positioned about said open end is metalic, said combustible member further including a quantity of adhesive material for securing said cup-shaped member to said open end of said container.

15. The percussively-ignitable member according to claim 10 wherein said container is comprised of glass.

* * * * *